US009788671B1

(12) United States Patent
Wuerz

(10) Patent No.: US 9,788,671 B1
(45) Date of Patent: Oct. 17, 2017

(54) BLANKET WITH TUCK FLAPS

(71) Applicant: Timothy Peter Wuerz, Lauderdale by the Sea, FL (US)

(72) Inventor: Timothy Peter Wuerz, Lauderdale by the Sea, FL (US)

( * ) Notice: Subject to any disclaimer, the term of this patent is extended or adjusted under 35 U.S.C. 154(b) by 30 days.

(21) Appl. No.: 14/999,264

(22) Filed: Apr. 18, 2016

(51) Int. Cl.

| | |
|---|---|
| ***A41D 3/08*** | (2006.01) |
| ***A47G 9/02*** | (2006.01) |
| ***A47G 9/10*** | (2006.01) |
| ***A41D 3/00*** | (2006.01) |
| *A41D 27/20* | (2006.01) |

(52) U.S. Cl.
CPC ..... *A47G 9/0223* (2013.01); *A41D 3/00* (2013.01); *A47G 9/1081* (2013.01); *A41D 27/205* (2013.01); *A41D 2200/20* (2013.01)

(58) Field of Classification Search
CPC ..... A47G 9/0223; A41D 3/00
See application file for complete search history.

(56) References Cited

U.S. PATENT DOCUMENTS 5,283,909 A * 2/1994 Hill ..... A47G 9/066 2/22
6,401,248 B1 6/2002 Christensen
6,435,185 B1 8/2002 Schimpl
6,643,870 B2 * 11/2003 Bertrand ..... A47G 9/066 2/69
6,966,069 B2 11/2005 Booth
2010/0212060 A1 * 8/2010 Whitcomb ..... A41B 13/06 2/75
2012/0005801 A1 * 1/2012 Parr ..... A41D 3/08 2/84
2014/0352063 A1 * 12/2014 Mitchell ..... A47G 9/0223 5/494
2016/0128498 A1 * 5/2016 Kingsmore ..... A41D 27/20 2/69.5

* cited by examiner

*Primary Examiner* — Kristen Matter

(57) ABSTRACT

A Blanket with tuck flaps with a sheet of flexible material, a hood member, a left tuck flap member, a right tuck flap member, a shoulder support member, and an arm support member. The planar sheet is wide enough to cover the front surface of an average person. The left and right side tuck flaps extend from the right side and left side of the sheet at the thigh level of the user. The shoulder support member is attached to the top of the planar sheet and supports the blanket on the user's shoulders. The hood is attached to the top side of the planar panel. The user's head protrudes through an aperture between the top of the planar panel and the shoulder support member. The arm support is attached at its top and bottom edge to the inside of the planar sheet at the location of the user's torso.

6 Claims, 9 Drawing Sheets

BLANKET WITH TUCK FLAPS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of personal blankets and more specifically to a blanket with tuck flaps.

Blankets are well known for keeping people warm either indoors or outdoors. Specialized blankets have been developed to fulfill specific needs, for example while traveling in an airplane, or sitting at an outdoor event.

U.S. Pat. No. 6,401,248 discloses a travel blanket with hood that protects the torso and arms of a child when in a child's seat. U.S. Pat. No. 6,435,185 shows a travelers cover that includes a support for the user's arms. U.S. Pat. No. 6,966,069 also shows a travel blanket that includes an arm support.

However, there is a deficiency in the prior technology in that none of the above patents have side panels that extend out to the left and right of the main blanket that are strategically placed to tuck under the user's thighs to hold the blanket in place during use when sitting in a chair.

BRIEF SUMMARY OF THE INVENTION

The primary object of the invention is to provide a blanket that includes strategically placed side flaps that allow a person to tuck the sides of the blanket under the thigh portion of the user's legs.

Another object of the invention is to provide a blanket with tuck flaps that includes a privacy hood.

Another object of the invention is To provide a blanket with tuck flaps that includes a neck support pillow.

A further object of the invention is to provide a blanket with tuck flaps that includes a shoulder support system.

Yet another object of the invention is to provide a blanket with tuck flaps that includes an inner arm support system.

Still yet another object of the invention is to provide a blanket with tuck flaps that includes an outer pocket for holding electronic devices.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a blanket with tuck flaps comprising: a planar sheet of flexible material having a top side, a left and right side and a bottom side, a hood member, a left side tuck flap member, a right side tuck flap member, a shoulder support member, a neck pillow member, an arm support member, a pocket member, an elastic strap member; said planar sheet member being wide enough to cover the front surface of an average person, said left side tuck flap member extending from the right side of said planar sheet located at the left thigh portion of the user, said right side tuck flap member extending from the left side of said planar sheet located at the right thigh portion of the user, said shoulder support member being a flat, horizontally disposed panel that is attached to said top side of said planar sheet, said hood member attached to the top side of said planar panel where a user's head can protrude through a central aperture formed between said top side of said planar panel and said shoulder support member, said neck pillow member removably attached to the back portion of said hood member located near the user's shoulders, said arm support member being a rectangular flexible sheet attached at its top horizontal edge and bottom horizontal edge to the inside portion of said planar sheet in the location of the torso of the user creating an arm support when said user inserts his or her arms into the left and right openings of said arm support member, said pocket member attached to the outside of said planar sheet and capable of retaining an electronic device and said elastic strap member attached to said planar sheet in a loop fashion allowing it to retain said planar sheet when said planar sheet is rolled up for storage.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
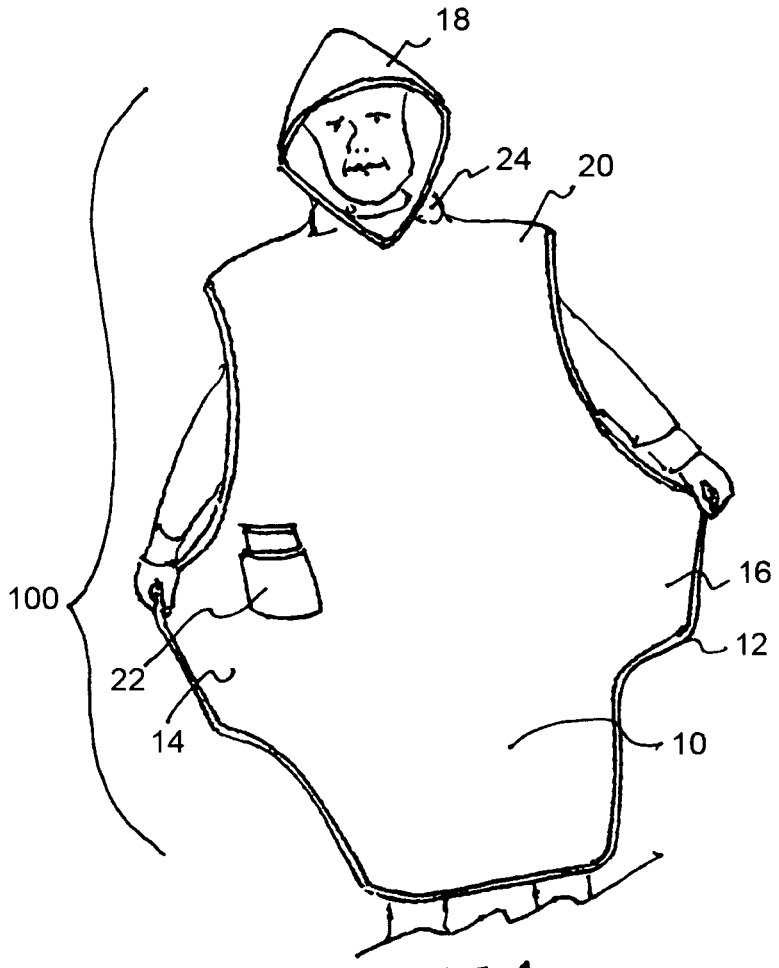
FIG. 1 is a front view of the invention being worn by the user.
Figure 4:
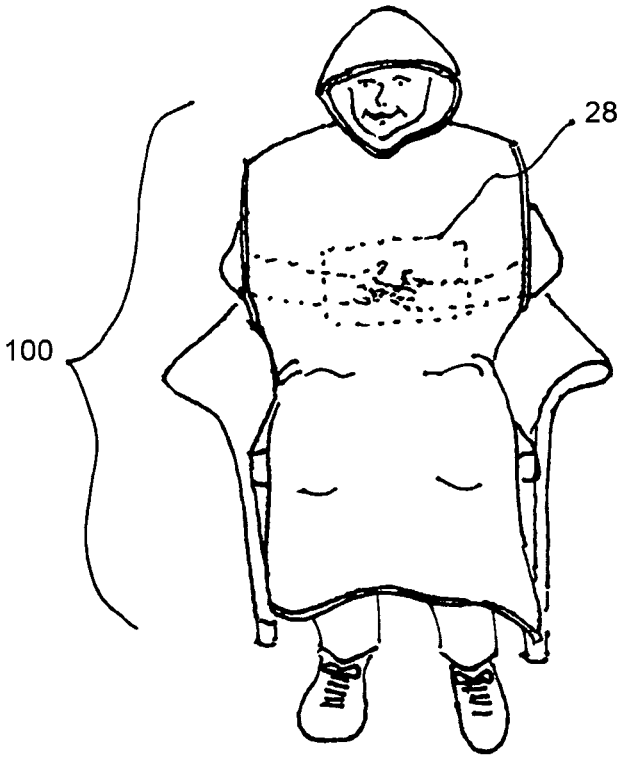
FIG. 4 is a perspective view of a person in the sitting position wearing the invention with arms tucked into the arm holding support.
Figure 5:
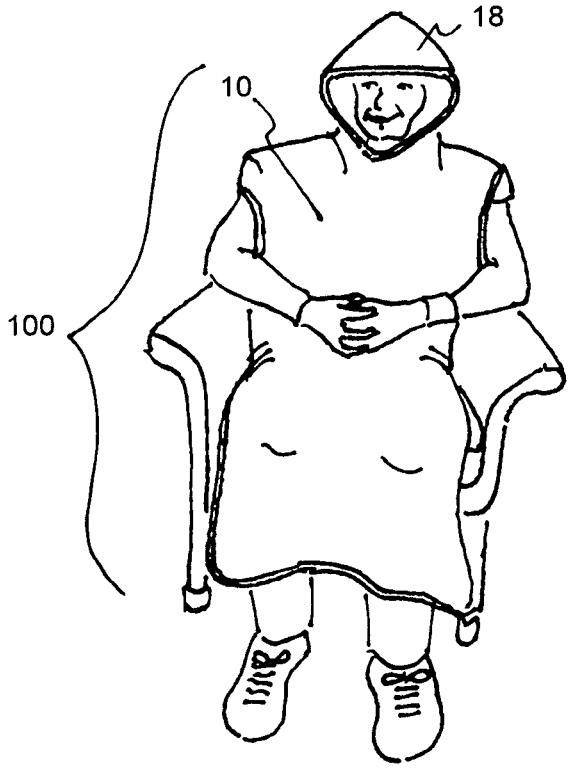
FIG. 5 is a perspective view of a person in the sitting position wearing the invention with arms extended and folded in front of the blanket.
Figure 6:
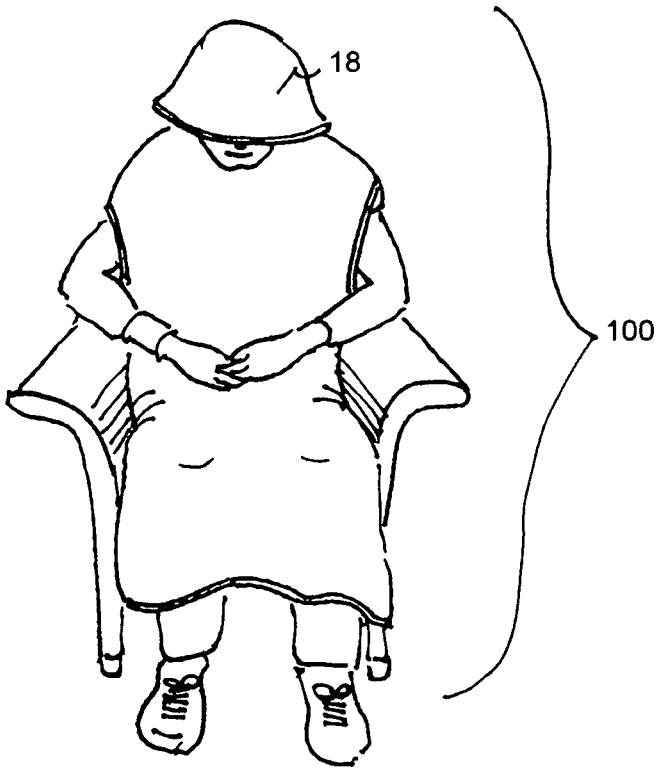
FIG. 6 is a perspective view of a person in the sitting position where the hood portion is pulled over a portion of the user's face.

Referring now to FIG. 1 we see a front view of the blanket 100 being worn by a user. The blanket 100 is a planar sheet of flexible material such as cotton, fleece, wool, or other material such as water resistant fabric. The main panel 10 is sized to cover the front portion of an average person. Various sizes can be made to specifically accommodate children, smaller adults or larger adults. In the preferred embodiment the main panel 10 includes a trim material 12 that reinforces the perimeter of the main panel 10. A left tab 14 and right tab 16 extend from the sides of the main panel 10 lining up with the location of the user's thighs when the user is in the sitting position as shown in FIGS. 4, 5 and 6. A hood portion 18 is attached to the top edge of the main panel 10. The user's neck can protrude through a central aperture between the top edge of the main panel 10 and a shoulder panel 20, shown on one side in FIG. 1 and on the opposite side in FIG. 3. The shoulder panel 20 helps support the main panel 10 so that the main panel 10 does not slip off of the user's shoulders during use. In one embodiment, the entire shoulder panel 20 is made of elastic material to allow individuals with larger shoulders to fit within the shoulder support envelope. A pocket 22 is attached to the front of main panel 10 and is sized to retain electronic devices such as a cell phone or small tablet.

Figure 2:
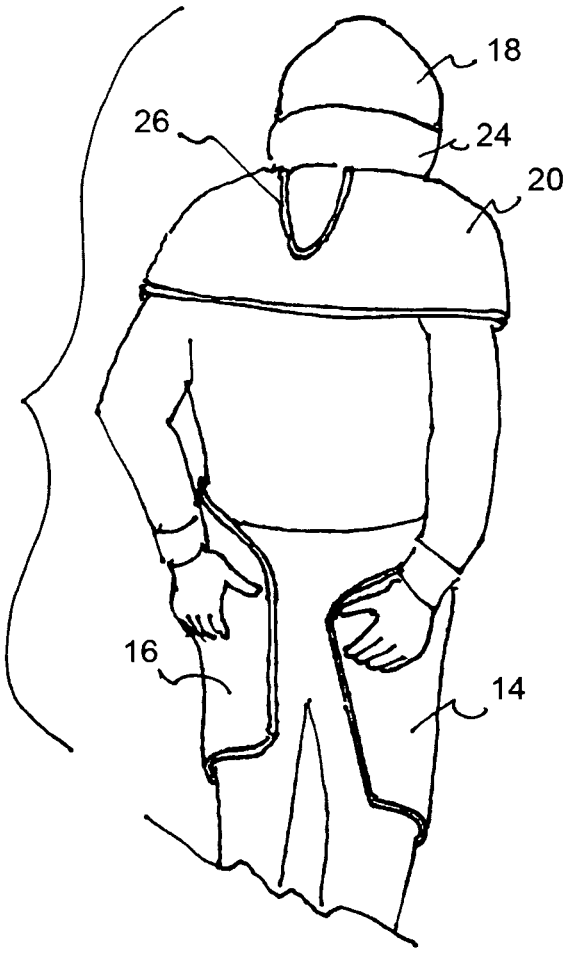
FIG. 2 is a perspective view of a person wearing the invention showing the application of the tuck flaps.

FIG. 2 is a perspective view showing the rear view of a person wearing the blanket 100. the left tab 14 and the right tab 16 are tucked behind the user so that when he sits down, the main panel 10 will be held securely in place while the rest of the user's back and legs are unencumbered by the blanket 100. The shoulder panel 20 sits over the user's shoulders and holds the top portion of the blanket 100 securely in place during use. The hood portion 18 covers the user's neck and head while a removable neck cushion 24 can serve as a neck support on high backed chairs such as those found on airplanes or motor vehicles. An elastic strap 26 is sewn in a loop pattern and can retain the entire blanket 100 assembly in a rolled position for storage or transport as shown in the perspective view in FIG. 9.

Figure 3:
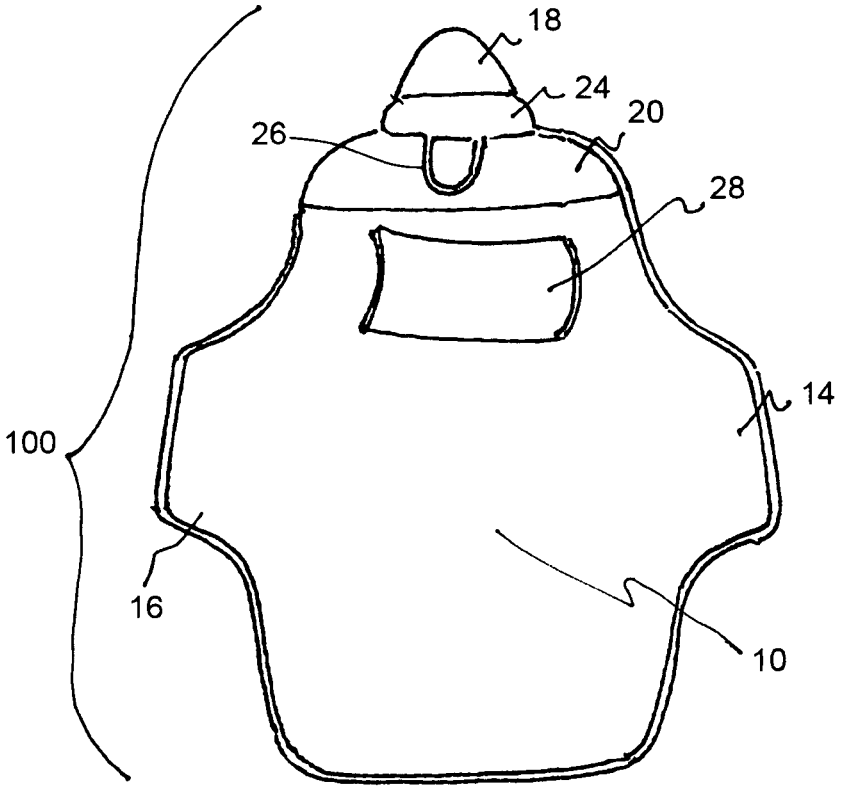
FIG. 3 is a rear plan view of the invention.

FIG. 3 is a plan view of the inside of the blanket 100 of the present invention. An arm support panel 28 can be seen that resides at the torso location of the user when worn. The top and bottom edges of the arm support panel 28 are sewn to the main panel 10. The left and right edges of the arm support panel 28 are open to allow the user to insert his or her arms into the arm support panel 28 as shown in dotted lines in FIG. 4. The resulting effect is to feel soothingly cradled by the blanket 100 both by the restraining action of the left tab 14 and the right tab 16, the supporting effect of arm support panel 28, the shoulder retaining support of shoulder panel 20 and the privacy hood 18. Indeed, the blanket 100 has been suggested for use by autistic individuals who feel greater calmness when feeling "hugged". The blanket 100 can be made of light weight fleece and used during air travel as a way to stay warm as well as a way to create a "cocoon" effect to insulate the traveler from the closeness of others being seated in close proximity to the user. The blanket 100 can also be made of water resistant materials and worn by people attending outdoor sporting events and the like.

FIG. 5 shows a person sitting in a chair with arm extending out from the sides of the main panel 10. This shows the versatility of the blanket 100 to allow the user the choice of cradling the arms within arm support panel 28 or having the arms free to perform actions such as reading, eating or drinking.

FIG. 6 is a perspective view of a person sitting in a chair with the hood portion 18 pulled down over the user's face. The top portion of the hood portion 18 is designed to be long enough to perform this task, which can be very useful when engaging in sleep in an otherwise lighted environment.

Figure 7:
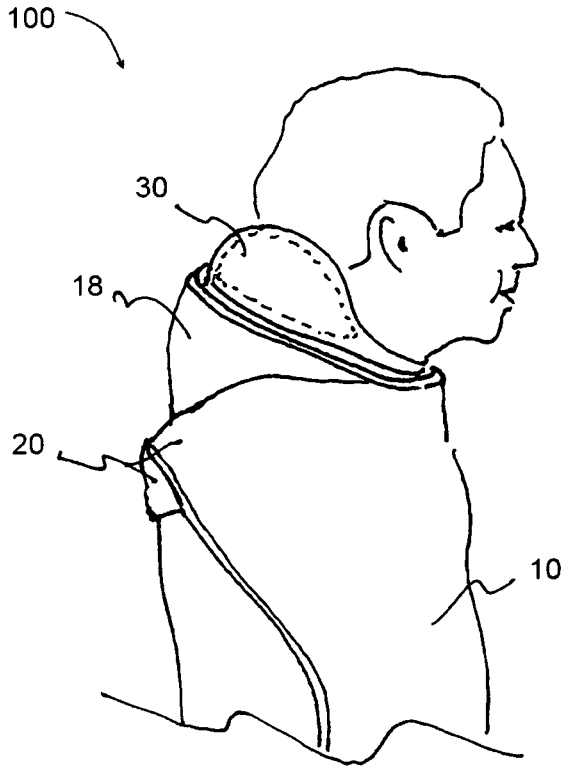
FIG. 7 is a partial side view of a person wearing the invention with the hood pulled back.

FIG. 7 is a partial side view of a person wearing the blanket 100. The hood 18 has been lowered and sits on shoulder panel 20. The neck pillow 30 can be seen as a dotted line located under the retracted hood 18 and is removable and replaceable by a closure such as Velcro®, or by a zipper, or by snaps.

Figure 8:
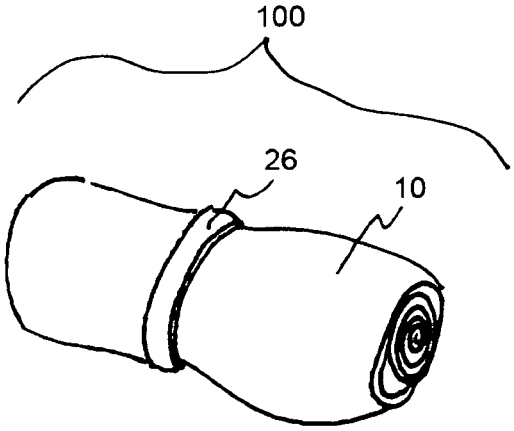
FIG. 8 is a perspective view of the invention in the rolled and stored position.

FIG. 8 is a perspective view of the blanket 100 in the rolled and stored position where elastic strap 26 has retained the rolled blanket 100.

Figure 9:
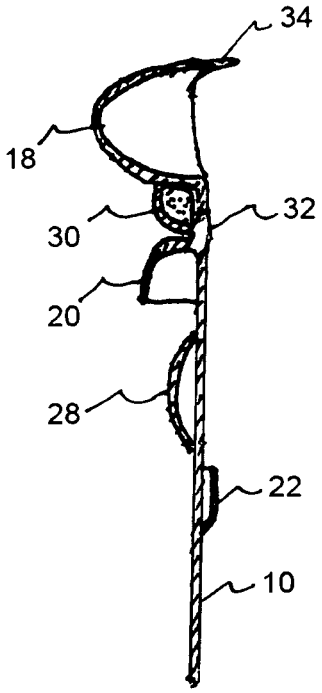
FIG. 9 is a side section view of the invention.

FIG. 9 is a side section view of the blanket 100. Pocket 22 can be seen attached to the front of the main panel 10. Arm support panel 28 can be seen attached to the inside of main panel 10. Shoulder panel 20 can be seen attached to the top edge of main panel 10. Aperture 32 allows the user's head to protrude through the top of the main panel 10. Privacy hood 18 can be seen with extra long portion 34 included to act as a privacy shield for the user's face if so desired.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A blanket comprising:

a main panel comprising a planar sheet of flexible material having a top side, a left side, a right side, and a bottom side;

a left side tuck flap member extending from the right side of the planar sheet and configured to tuck under a left thigh of a user;

a right side tuck flap member extending from the left side of said planar sheet and configured to tuck under a right thigh of said user;

a shoulder support member attached to the top side of the main panel, the shoulder support member comprising a flat, horizontally disposed panel;

a hood member attached to the top side of said main panel;

a central aperture formed between said top side of said main panel and said shoulder support member, the central aperture allowing a head of the user to protrude through while shoulders of the user are covered by the shoulder support member;

a neck pillow member removably attached to a back portion of said hood member;

an arm support member comprising a flexible sheet including a top edge and a bottom edge, the top and bottom edges being attached to an inside of said main panel thereby allowing arms of the user to be inserted into left and right openings of said arm support member.

2. The blanket as claimed in claim 1, wherein said main panel is made of fleece, wool, cotton, waterproof fabric or flexible plastic.

3. The blanket as claimed in claim 1, wherein said shoulder support member is configured to provide support to said main panel and prevent the blanket from sliding down a front of the user's body during use.

4. The blanket as claimed in claim 1, wherein said shoulder support member is made of elastic material to allow people with large shoulders to wear said blanket.

5. The blanket as claimed in claim 1, further comprising a pocket member attached to an outside of said main panel.

6. The blanket as claimed in claim 1, further comprising an elastic strap member forming a loop attached to said main panel for retaining the main panel in a rolled position for storage.

* * * * *